US011375816B1

(12) United States Patent
Deng

(10) Patent No.: US 11,375,816 B1
(45) Date of Patent: Jul. 5, 2022

(54) ADJUSTABLE CHAIR

(71) Applicant: Shenzhen Microtouch Ergonomic Technology Inc., Shenzhen (CN)

(72) Inventor: Jianbo Deng, Shenzhen (CN)

( * ) Notice: Subject to any disclaimer, the term of this patent is extended or adjusted under 35 U.S.C. 154(b) by 0 days.

(21) Appl. No.: 17/123,885

(22) Filed: Dec. 16, 2020

(51) Int. Cl.
*A61G 5/14* (2006.01)
*A47C 3/30* (2006.01)
*A47C 7/58* (2006.01)

(52) U.S. Cl.
CPC ..... *A47C 3/30* (2013.01); *A47C 7/58* (2013.01); *A61G 5/14* (2013.01)

(58) Field of Classification Search
CPC ..... A47C 1/0242; A47C 1/03211; A47C 3/30; A47C 7/50; A47C 7/58; A61G 5/14
USPC ..... 297/234, 330, 423.1, 423.21, DIG. 10
See application file for complete search history.

(56) References Cited

U.S. PATENT DOCUMENTS 1,063,809 A * 6/1913 Lawson ..... A47C 7/024 297/233
4,461,444 A * 7/1984 Grassi ..... B60N 2/501 297/344.17 X
6,113,188 A * 9/2000 Stewart ..... A61G 5/14 297/DIG. 10 X
6,540,250 B1 * 4/2003 Peterson ..... A61G 5/042 297/DIG. 10 X
6,811,220 B2 * 11/2004 Shea ..... A61G 5/14 297/DIG. 10 X
8,360,524 B2 * 1/2013 Demi ..... B60N 2/508 297/344.15
8,398,171 B2 * 3/2013 Lin ..... A61G 5/14 297/330
8,936,306 B2 * 1/2015 Liu ..... A47C 11/00 297/234 X
9,289,066 B2 * 3/2016 Wallace ..... A47C 1/06
9,713,560 B1 * 7/2017 Raymond ..... A61G 5/1059
9,968,195 B2 * 5/2018 Sheinkop ..... A47C 7/002
10,758,439 B1 * 9/2020 Lake ..... A47C 7/02
11,160,704 B2 * 11/2021 Stajic ..... A47C 13/00
2003/0011229 A1 * 1/2003 Bell ..... A61G 5/1059 297/344.17
2013/0306831 A1 * 11/2013 Keen ..... A47C 7/5062 248/599
2016/0022517 A1 * 1/2016 Frangos ..... A61G 5/1054 280/657
2016/0310334 A1 * 10/2016 Bliem ..... A47C 3/22

FOREIGN PATENT DOCUMENTS

CN 109157040 A * 1/2019 ..... A47C 3/30

* cited by examiner

*Primary Examiner* — Rodney B White

(57) ABSTRACT

An adjustable chair, belonging to the field of office furniture, comprising a base frame. A chair back is disposed at the rear end of the base frame. A lifting assembly is disposed on the base frame and provided with a seat, and comprises a bottom frame and a top frame formed with sliding slots. The seat is disposed on the top frame and the seat angle can be adjusted. By adjusting the height of the chair through the lifting assembly and adjusting the rotation angle of the seat, users not only can stand and lean against the chair, but also can normally sit on the chair.

8 Claims, 3 Drawing Sheets

ADJUSTABLE CHAIR

BACKGROUND OF THE INVENTION

1. Technical Field

This disclosure belongs to the field of office appliances, and particularly relates to an adjustable chair.

2. Description of Related Art

At present, people spend ever longer time sitting in front of a computer at work, and many health issues are caused by sedentary schedules. Nowadays, more and more people are starting to work in a standing posture (both the feet and hips are stressed), and more and more chairs specially used for standing and leaning are designed, accordingly. However, these chairs cannot realize normal sitting (the hips are stressed);

Existing adjustable chairs adopting a single pneumatic actuator can only rise or fall once. Because of the restraint of the moving distance of the pneumatic actuator, the chairs cannot be kept low enough to allow users to sit thereon or be high enough to allow the users to stand and lean against.

BRIEF SUMMARY OF THE INVENTION

The objective of this disclosure is to overcome the defects of the prior art by providing an adjustable chair which is not only suitable for standing and leaning, but also suitable for normal sitting.

The objective of this disclosure may be realized through the following technical solution:

An adjustable chair comprises a base frame, wherein a chair back is disposed at the rear end of the base frame, a lifting assembly is disposed on the base frame, a seat capable of vertically rotating is disposed on the lifting assembly, the lifting assembly comprises a bottom frame and a top frame which are both formed with sliding slots, the seat is disposed on the top frame, the chair back is disposed on the bottom frame, at least two cross connecting rod assemblies are disposed between the bottom frame and the top frame, cross connecting rods of the cross connecting rod assemblies are connected through shafts, two ends of one cross connecting rod of each cross connecting rod assembly are respectively hinged and fixed to the bottom frame and the top frame, and two ends of the other cross connecting rod of each cross connecting rod assembly slide along the corresponding sliding slot in the bottom frame or the top frame;

Furthermore, clamping strips are hinged between the cross connecting rods of the adjacent cross connecting rod assemblies and disposed on the cross connecting rods located on sliding blocks;

Strip-shaped clamping grooves which are distributed in a linear array are formed in the bottom frame, and the clamping strips are clamped in the strip-shaped clamping grooves.

Furthermore, the cross connecting rods of the adjacent cross connecting rod assemblies are connected through fixing strips.

Furthermore, a first pneumatic actuator is disposed at the lower end of the base frame.

Furthermore, a support base is arranged at the bottom end of the first pneumatic actuator and is used to support the first pneumatic actuator;

The support base comprises a horizontal base and a sloping base arranged on the horizontal base, wheels are disposed at the lower end of the sloping base, and the first pneumatic actuator is disposed at the upper end of the sloping base.

Furthermore, a soft material is laid on the horizontal base of the support base.

Furthermore, the seat is hinged to the top frame;

A locking mechanism is disposed on a hinge point of the seat and the top frame and is used to lock the seat and the top frame to prevent the seat and the top frame from rotating.

Furthermore, inner sides of the cross connecting rods, sliding along the sliding slots in the bottom frame and the top frame, of the cross connecting rod assemblies are hinged and connected to piston rods of second pneumatic actuators, and cylinder seats of the second pneumatic actuators are hinged to the bottom frame.

Furthermore, flexible parts are arranged in sliding slots and each have an end firmly connected to the inner wall of the corresponding sliding slot and an end fixedly connected to an end of the cross connecting rod, corresponding to the sliding slot, of one cross connecting rod assembly.

Furthermore, two ends of the other cross connecting rod of each cross connecting rod assembly are respectively hinged to sliding blocks, and the sliding blocks are disposed in the corresponding sliding slots in the bottom frame or the top frame and are able to slide along the corresponding sliding slots in the bottom frame or the top frame;

Flexible parts are arranged in the sliding slots and each have an end firmly connected to the inner wall of the corresponding sliding slot and an end fixedly connected to the sliding block corresponding to the sliding slot.

This disclosure has the following beneficial effects:

By adjusting the height of the chair through the lifting assembly and adjusting the rotation angle of the seat, users not only can stand and lean against the chair, but also can normally sit on the chair.

BRIEF DESCRIPTION OF THE SEVERAL VIEWS OF THE DRAWINGS

To more clearly explain the technical solutions of the embodiments of this disclosure or the prior art, drawings required for the description of the embodiments of this disclosure or the prior art are briefly introduced below. Obviously, those ordinarily skilled in the art can obtain other drawings according to the following ones without creative labor.

DETAILED DESCRIPTION OF THE INVENTION

The technical solutions of the embodiments of this disclosure will be clearly and completely described below in conjunction with the accompanying drawings of the embodiments. Clearly, the embodiments described hereafter are merely illustrative ones, and are not all possible ones of this disclosure. All other embodiments obtained by those ordinarily skilled in the art on the basis of the following ones without creative labor should also fall within the protection scope of this disclosure.

Figure 1:
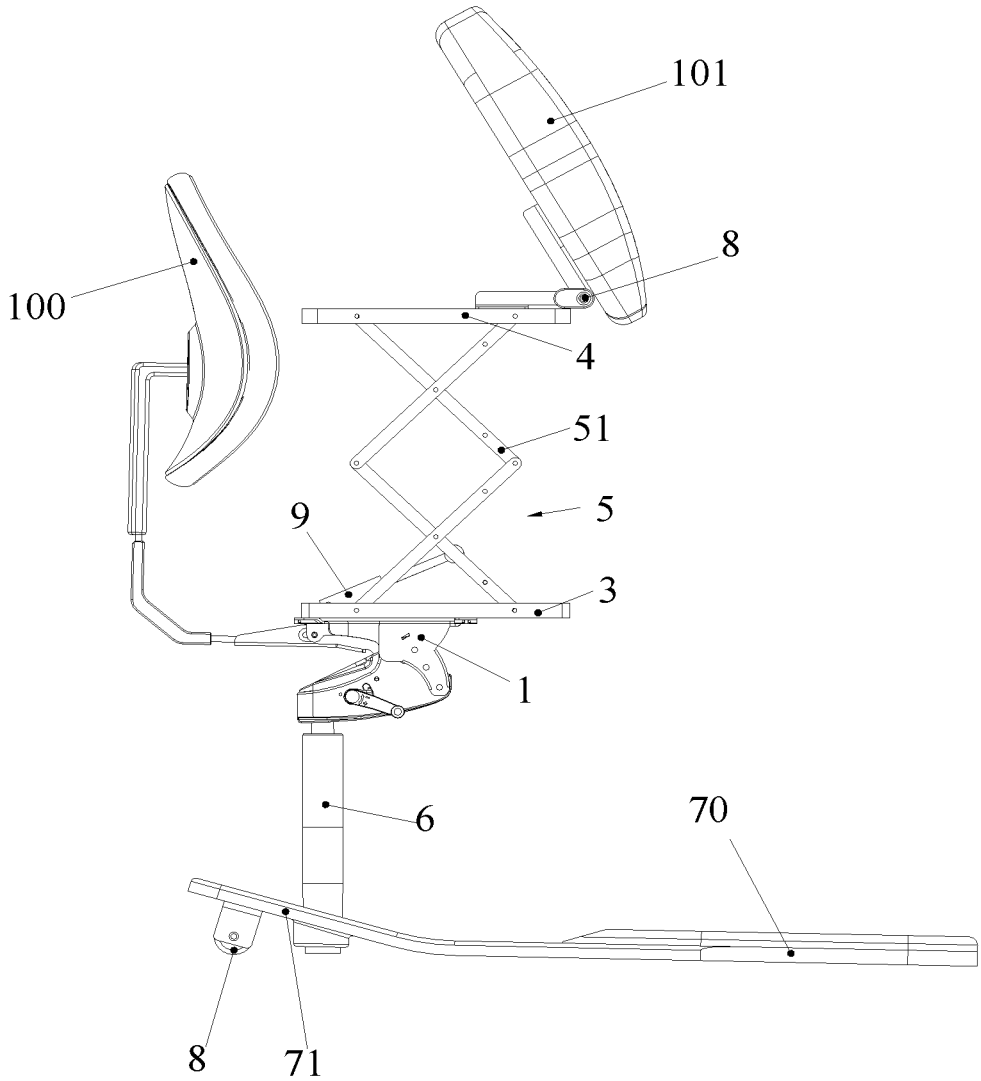
FIG. 1 is an overall structural view of an embodiment of this disclosure.
Figure 2:
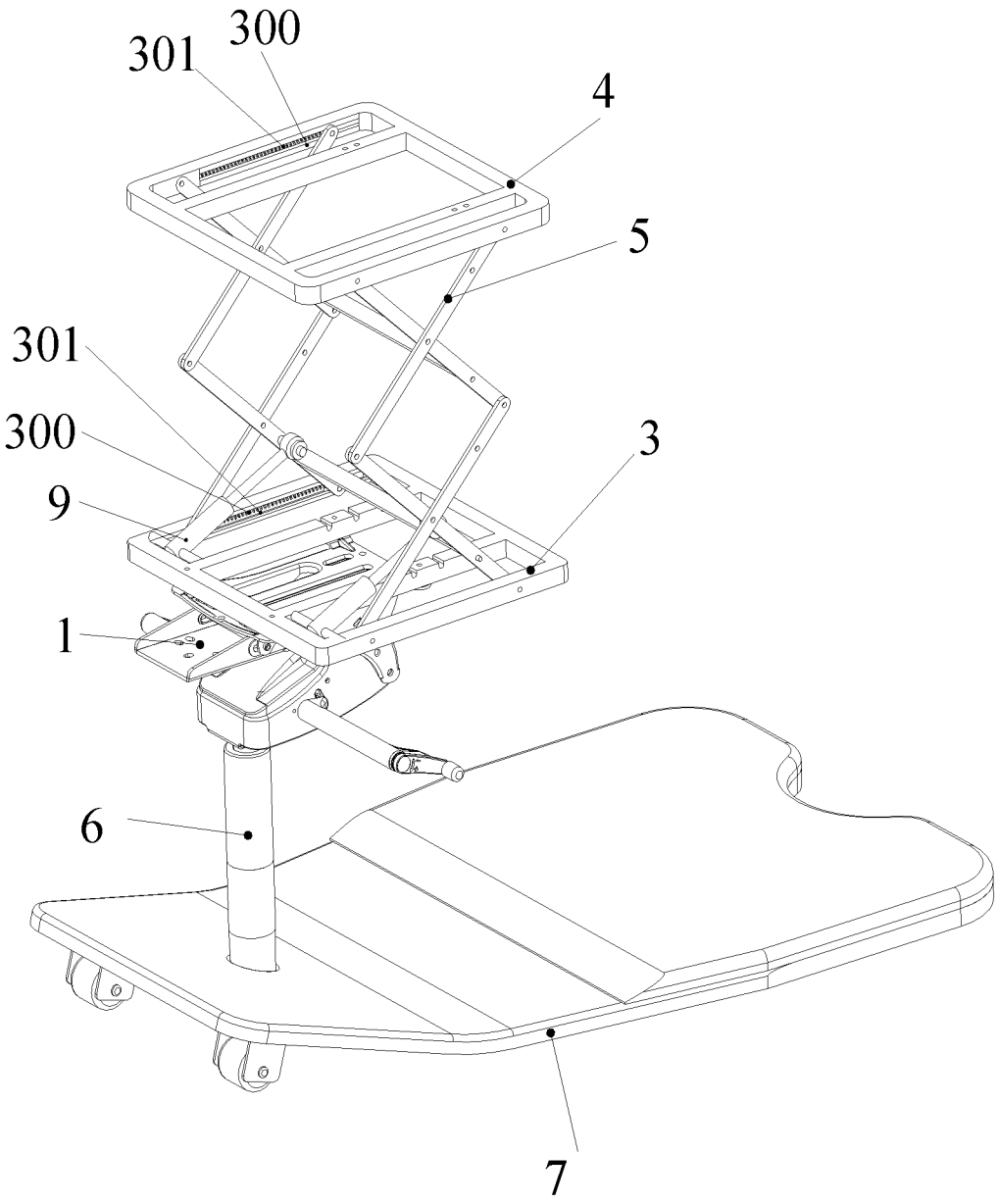
FIG. 2 is a partial structural view of the embodiment of this disclosure.
Figure 3:
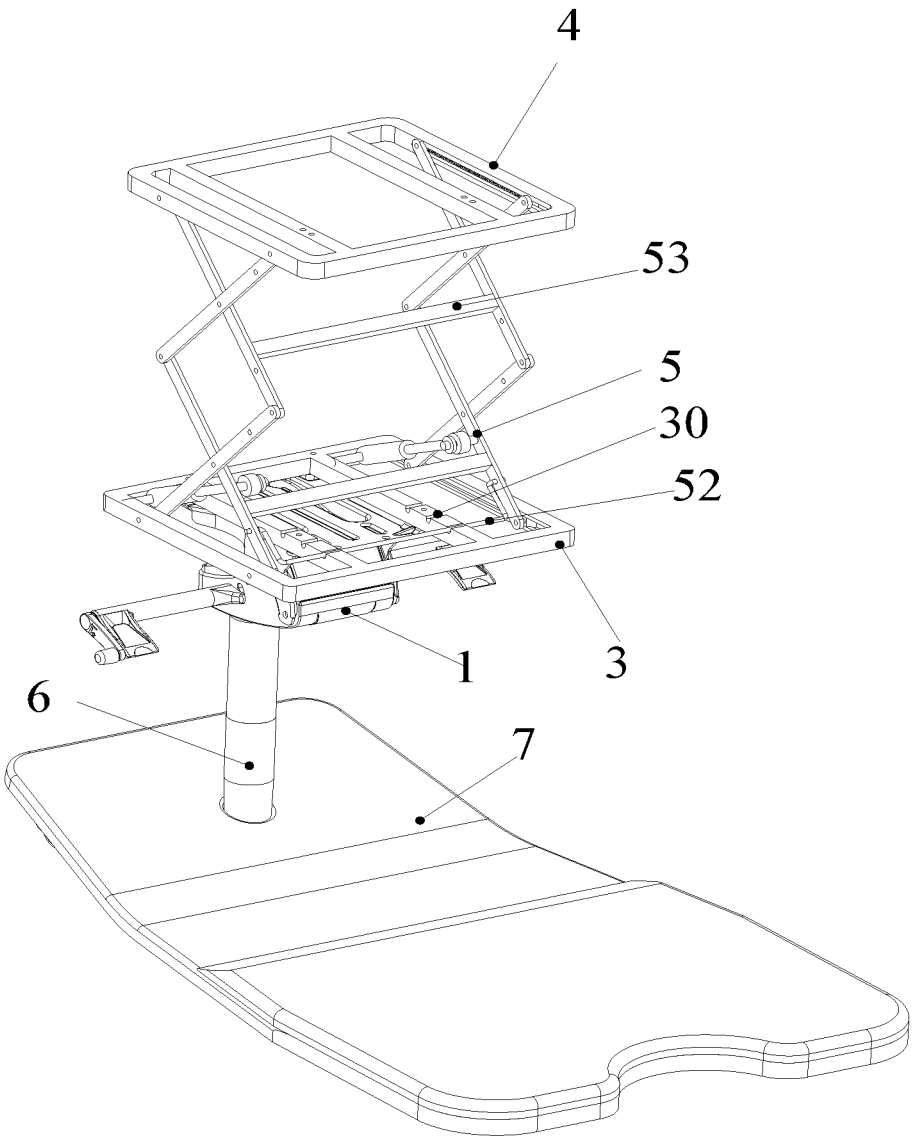
FIG. 3 is a structural view, from another perspective, of FIG. 2 of the embodiment of this disclosure.

As shown in FIG. 1 to FIG. 3, an adjustable chair comprises a base frame 1, wherein a chair back 100 is disposed at the rear end of the base frame 1, a lifting assembly is disposed on the base frame 1, and a seat 101 capable of rotating vertically is disposed on the lifting assembly.

During use, the seat 101 rotates vertically with respect to the chair back 100 to be vertically tilted or horizontal. When the seat 101 is vertically tilted, a user can stand and lean against the seat 101 (both the feet and hips are stressed) at work (hereinafter referred to as a "standing and leaning position" to facilitate the description). When the seat 101 is horizontal, the user can normally sit on the seat 101 at work (hereinafter referred to as a "sitting position" to facilitate the description). When the seat 101 is vertically tiled or horizontal, the height of the seat 101 can be adjusted through the lifting assembly to ensure an optimum height of the seat 101.

In this embodiment, the lifting assembly comprises a bottom frame 3 and a top frame 4 which are both formed with sliding slots 300, wherein the seat 101 is disposed on the top frame 4, the chair back 100 is disposed on the bottom frame 3, at least two cross connecting rod assemblies 5 are disposed between the bottom frame 3 and the top frame 4, cross connecting rods 51 of the cross connecting rod assemblies 5 are connected through shafts, two ends of one cross connecting rod 51 of each cross connecting rod assembly 5 are respectively hinged and fixed to the bottom frame 3 and the top frame 4, and two ends of the other cross connecting rod 51 of each cross connecting rod assembly 5 slide along the corresponding sliding slot 300 in the bottom frame 3 or the top frame 4.

Clamping strips 52 are hinged between the cross connecting rods 51 of the adjacent cross connecting rod assemblies 5 and are disposed on the cross connecting rods 51 located on sliding blocks.

Strip-shaped clamping grooves 30 which are distributed in a linear array are formed in the bottom frame 3, and the clamping strips 52 are clamped in the strip-shaped clamping grooves 30.

During use, the top frame 4 is pressed or lifted to change the overall height of the cross connecting rod assemblies 5, so as to adjust the height of the seat 101. After the height of the seat is adjusted, the clamping strips 52 are clamped in the strip-shaped clamping grooves 30 to remain the overall height of the cross connecting rod assemblies 5 stable.

In this embodiment, inner sides of the cross connecting rods 51, sliding along the sliding slots 300 in the bottom frame 3 and the top frame 4, of the cross connecting rod assemblies 5 are hinged and connected to piston rods of second pneumatic actuators 9, and cylinder seats of the second pneumatic actuators 9 are hinged to the bottom frame 3. The second pneumatic actuators 9 are used as a power source to adjust the overall height of the cross connecting rod assemblies 5.

In this embodiment, springs 301 are arranged in the sliding slots 300, one end of each spring 301 is firmly connected to the inner wall of the corresponding sliding slot 300, and the other end of each spring 301 is fixedly connected to the end of the corresponding cross connecting rod 51 of one cross connecting rod assembly 5. The cross connecting rods 51, located in the sliding slots 300, of the cross connecting rod assemblies 5 can restore by means of the springs 301.

In another embodiment, two ends of the other cross connecting rod 51 of each cross connecting rod assembly 5 are respectively hinged to sliding blocks, and the sliding blocks are respectively disposed in the corresponding sliding slots 300 in the bottom frame 3 or the top frame 4 and are able to slide along the corresponding sliding slots 300 in the bottom frame 3 or the top frame 4;

Springs 301 are arranged in the sliding slots 300, one end of each spring 301 is firmly connected to the inner wall of the corresponding sliding slot 300, and the other end of each spring 301 is fixedly connected to the sliding block corresponding to the sliding slot 300.

The sliding blocks slide along the sliding slots 300 to drive the ends of the corresponding cross connecting rods 51 of the cross connecting rod assemblies 5 to move, and meanwhile, the springs 301 can restore the sliding blocks to enable the cross connecting rods 51, located in the sliding slots, of the cross connecting rod assemblies 5 to restore.

In another embodiment, the springs 301 are springs, flexible bars or the like.

In this embodiment, the cross connecting rods 51 of the adjacent cross connecting rod assemblies 5 are connected through fixing strips 53. In this way, the cross connecting rods 51 of the adjacent cross connecting rod assemblies 5 can move synchronously to ensure that the cross connecting rod assemblies 5 can rise or fall more steadily.

In another embodiment, a first pneumatic actuator 6 is arranged at the lower end of the base frame 1. The height of the base frame 1 can be adjusted by means of the first pneumatic actuator 6, so the height of the chair back 100 and the height of the seat 101 can be adjusted as actually needed.

In another embodiment, a support base 7 is arranged at the bottom end of the first pneumatic actuator 6 and is used to support the first pneumatic actuator 6. Wheels 8 are arranged on the support base 7, and the whole chair can be pushed to be transferred by means of the wheels 8.

In one scenario, the support base 7 comprises a horizontal base 70 and a sloping base 71 arranged on the horizontal base 70, wherein the wheels 8 are disposed at the lower end of the sloping base 71, and the first pneumatic actuator 6 is disposed at the upper end of the sloping base 71. During use, a user stands on the horizontal base 70 to lean against the chair, and at this moment, the sloping base 71 tilts upwards to lift the wheels 8 on the sloping base 71 off the ground, so that the stability of the chair is guaranteed when the user stands and leans against the chair.

In one embodiment, a soft material such as a PU sponge is laid on the horizontal base 70 of the support base 7.

In one embodiment, the seat 101 is hinged to the top frame 4;

A locking mechanism 8 is disposed on a hinge point of the seat 101 and the top frame 4 and is used to lock the seat 101 and the top frame 4 to prevent the seat 101 and the top frame 4 from rotating, so as to keep the angle between the seat 101 and the top frame 4 constant. The angle between the seat 101 and the top frame 4 can be adjusted as actually needed by vertical rotation of the seat 101.

The locking mechanism 8 may be an existing locking knob, a fastening button, or a fastening bolt that can keep the angle between the seat 101 and the top frame 4 constant.

In this specification, reference terms such as "one embodiment", "example" and "specific example" are intended to indicate that the specific characteristics, structures, materials or features described in this embodiment or example are included in at least one embodiment or example of this disclosure. In this specification, illustrative presentations of these terms do not refer to identical embodiments or examples. In addition, the specific characteristics, structures, materials or features described can be properly combined in any one or more embodiments or examples.

The basic principle, major characteristics and advantages of this disclosure are represented and described above.

Those skilled in the art would appreciate that this disclosure is not limited to the above embodiments, and that the above embodiments and the description in this specification are merely for explaining the principle of this disclosure. Different alterations and improvements of this disclosure can be made without departing from the spirit and scope of this disclosure, and all these alterations and improvements should also fall within the protection scope of this disclosure.

What is claimed is:

1. An adjustable chair, comprising a base frame (1), a chair back (100) being disposed at a rear end of the base frame (1), a lifting assembly being disposed on the base frame (1), a seat (101) capable of vertically rotating being disposed on the lifting assembly, wherein the lifting assembly comprises a bottom frame (3) and a top frame (4) which are both formed with sliding slots (300), the seat (101) is disposed on the top frame (4), the chair back (100) is disposed on the bottom frame (3), at least two cross connecting rod assemblies (5) are disposed between the bottom frame (3) and the top frame (4), cross connecting rods (51) of the cross connecting rod assemblies (5) are connected through shafts, two ends of one said cross connecting rod (51) of each said cross connecting rod assembly (5) are respectively hinged and fixed to the bottom frame (3) and the top frame (4), and two ends of another said cross connecting rod (51) of each said cross connecting rod assembly (5) slide along the corresponding sliding slot (300) in the bottom frame (3) or the top frame (4);

wherein clamping strips (52) are hinged between the cross connecting rods (51) of the adjacent cross connecting rod assemblies (5) and are disposed on the cross connecting rods (51) located on sliding blocks;

strip-shaped clamping grooves (30) which are distributed in a linear array are formed in the bottom frame (3), and the clamping strips (52) are clamped in the strip-shaped clamping grooves (30).

2. The adjustable chair according to claim 1, wherein the cross connecting rods (51) of the adjacent cross connecting rod assemblies (5) are connected through fixing strips (53).

3. The adjustable chair according to claim 1, wherein a first pneumatic actuator (6) is disposed at a lower end of the base frame (1).

4. The adjustable chair according to claim 3, wherein a support base (7) is arranged at a bottom end of the first pneumatic actuator (6) and is used to support the first pneumatic actuator (6);

the support base (7) comprises a horizontal base (70) and a sloping base (71) arranged on the horizontal base (70), wheels (8) are disposed at a lower end of the sloping base (71), and the first pneumatic actuator (6) is disposed at an upper end of the sloping base (71).

5. The adjustable chair according to claim 4, wherein a soft material is laid on the horizontal base (70) of the support base (7).

6. The adjustable chair according to claim 1, wherein the seat (101) is hinged to the top frame (4);

a locking mechanism (8) is disposed on a hinge point of the seat (101) and the top frame (4) and is used to lock the seat (101) and the top frame (4) to prevent the seat (101) and the top frame (4) from rotating.

7. The adjustable chair according to claim 1, wherein springs (301) are arranged in sliding slots (300) and each have an end firmly connected to an inner wall of the corresponding sliding slot (300) and an end fixedly connected to an end of the cross connecting rod (51), corresponding to the sliding slot (300), of one said cross connecting rod assembly (5).

8. The adjustable chair according to claim 1, wherein two ends of another cross connecting rod (51) of each said cross connecting rod assembly (5) are respectively hinged to sliding blocks, and the sliding blocks are respectively disposed in the corresponding sliding slots (300) in the bottom frame (3) or the top frame (4) and are able to slide along the corresponding sliding slots (300) in the bottom frame (3) or the top frame (4);

springs (301) are arranged in the sliding slots (300) and each have an end firmly connected to an inner wall of the corresponding sliding slot (300) and an end fixedly connected to the sliding block corresponding to the sliding slot (300).

* * * * *